US008790136B2

(12) United States Patent
Duesterhoeft

(10) Patent No.: US 8,790,136 B2
(45) Date of Patent: Jul. 29, 2014

(54) HEADER ASSEMBLY CONFIGURED TO BE COUPLED TO A CASING

(71) Applicant: Tyco Electronics Corporation, Berwyn, PA (US)

(72) Inventor: Scott Stephen Duesterhoeft, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 23 days.

(21) Appl. No.: 13/645,193

(22) Filed: Oct. 4, 2012

(65) Prior Publication Data

US 2014/0099822 A1 Apr. 10, 2014

(51) Int. Cl.
*H01R 13/648* (2006.01)

(52) U.S. Cl.
USPC ..... 439/607.35; 439/101

(58) Field of Classification Search
USPC ..... 439/63, 92, 101, 108, 607.35, 607.36, 439/607.4, 581, 582, 947
See application file for complete search history.

(56) References Cited

U.S. PATENT DOCUMENTS

| | | | | |
|---|---|---|---|---|
| 5,046,952 | A * | 9/1991 | Cohen et al. | 439/63 |
| 5,108,300 | A | 4/1992 | Weber | |
| 5,167,536 | A * | 12/1992 | Wang | 439/620.1 |
| 5,326,280 | A | 7/1994 | Briones et al. | |
| 6,099,350 | A * | 8/2000 | Wright | 439/582 |
| 6,129,563 | A * | 10/2000 | Weidner | 439/92 |
| 6,152,743 | A * | 11/2000 | Fox | 439/63 |
| 6,386,888 | B1 * | 5/2002 | Skopic et al. | 439/63 |
| 6,390,825 | B1 * | 5/2002 | Handley et al. | 439/63 |
| 7,029,286 | B2 * | 4/2006 | Hall et al. | 439/63 |
| 7,101,189 | B1 | 9/2006 | Huss et al. | |
| 7,150,648 | B1 * | 12/2006 | Hall et al. | 439/581 |
| 8,430,675 | B2 * | 4/2013 | Hardy et al. | 439/63 |

FOREIGN PATENT DOCUMENTS

CN 202 276 022 U 6/2012

OTHER PUBLICATIONS

Technical Data Sheet, 59S20X-40ML5-Y, Fakra—HF PCB Right Angle Plug, Mar. 12, 2009, 3 pgs, Rosenberger Hochfrequenztechnik GmbH & Co, KG, Tittmoning, Germany.
International Search Report, International Application No. PCT/US2013/059849, International Filing Date, Sep. 16, 2013.

* cited by examiner

*Primary Examiner* — Thanh Tam Le

(57) ABSTRACT

A header assembly includes a center contact, a dielectric body surrounding the center contact and an outer housing holding the center contact and the dielectric body. The outer housing has a rear shell mounted to a circuit board and positioned interior of the casing. The outer housing has an outer contact extending from the rear shell that extends through an opening in the casing with a portion of the outer contact positioned exterior of the casing. The dielectric body is received in the outer contact. A shield member is coupled to the outer housing. The shield member engages the outer contact to electrically connect the shield member to the outer housing. The shield member has spring fingers that engage the casing at the opening. The spring fingers electrically connect the outer housing to the casing.

19 Claims, 4 Drawing Sheets

HEADER ASSEMBLY CONFIGURED TO BE COUPLED TO A CASING

BACKGROUND OF THE INVENTION

The subject matter herein relates generally to header assemblies.

Radio frequency (RF) coaxial connector assemblies have been used for numerous automotive applications, such as global positioning systems (GPS), car radios, mobile phones, air bag systems, and multimedia devices. Some connector assemblies are coaxial cable assemblies terminated to ends of coaxial cables. Coaxial cables typically consist of an outer conductor, an inner conductor, a dielectric, and a jacket or outer insulation. The outer conductor and the inner conductor of the cable electrically interface with corresponding inner and outer contacts of the connector, which may be a jack or a plug connector. Other connector assemblies are terminated to a circuit board rather than a cable. For interfacing with coaxial cable assemblies, such board mounted assemblies include a coaxial interface defined by a center contact and an outer contact surrounding the center contact. Both contacts are terminated to the circuit board.

In order to standardize various types of connectors and thereby avoid confusion, certain industry standards have been established. One of these standards is referred to as FAKRA. FAKRA is the Automotive Standards Committee in the German Institute for Standardization, representing international standardization interests in the automotive field. The FAKRA standard provides a system, based on keying and color coding, for proper connector attachment. The keying and color identifying features of a FAKRA connector are typically on an outer housing made of plastic or non-conductive material. Like jack keys can only be connected to like plug keyways in FAKRA connector assemblies. Secure positioning and locking of connector housings is facilitated by way of a FAKRA defined catch on the jack housing and a cooperating latch on the plug housing.

In some applications such as an automobile radio, the connector must be grounded to the chassis of the radio. However, since the outer housing is non-conductive, current connectors require a separate means to ground the connector to the chassis. Additionally, due to the large size of the connectors, which are loaded through an opening in the chassis, the opening in the chassis is large and is an area of EMI leakage. To close the openings and provide shielding for the radio, plates are typically secured to the panel of the chassis after the connectors are positioned in the device. Assembly of the plates to the panel is time consuming and difficult.

A need remains for a connector assembly that provides shielding for the opening in the chassis panel in a reliable manner.

BRIEF DESCRIPTION OF THE INVENTION

In one embodiment, a header assembly is provided that is configured to be coupled to a casing. The header assembly includes a center contact extending along a longitudinal axis, a dielectric body surrounding the center contact and an outer housing holding the center contact and the dielectric body. The outer housing has a rear shell configured to be mounted to a circuit board and configured to be positioned interior of the casing. The outer housing has an outer contact extending from the rear shell that is configured to extend through an opening in the casing with a portion of the outer contact positioned exterior of the casing. The dielectric body is received in the outer contact. A shield member is coupled to the outer housing. The shield member engages the outer contact to electrically connect the shield member to the outer housing. The shield member has spring fingers being configured to engage the casing at the opening. The spring fingers are configured to electrically connect the outer housing to the casing.

Optionally, the shield member may be coupled to the outer housing prior to coupling the header assembly to the casing. The shield member may be loaded into electrical connection with the casing with the outer housing as a unit. The shield member may directly engage both the outer contact and the rear shell. At least a portion of each spring finger may pass into the opening in the casing. The spring fingers may be deflectable toward the rear shell when engaged by the opening wall.

Optionally, the rear shell may include a front wall with the outer contact extending forward from the front wall. The shield member may abut against the front wall with the spring fingers extending rearward along the rear shell. The spring contacts may be spring biased against the outer contact to hold the shield member on the outer housing by an interference fit. The shield member may include a plate with the spring fingers extending from corresponding edges of the plate. The plate may have an opening therethrough with the spring contacts extending into the opening. The outer contact may be received in the opening and engage the spring contacts in the opening.

Optionally, the header assembly may include a nose cone coupled to a front end of the outer housing. The nose cone may surround the outer contact. The nose cone may have keys along an exterior thereof. The shield member may be captured between the nose cone and the rear shell. Optionally, the shield member may include grounding fingers that are configured to engage and be electrically connected to a ground circuit of a circuit board.

DETAILED DESCRIPTION OF THE INVENTION

Figure 1:
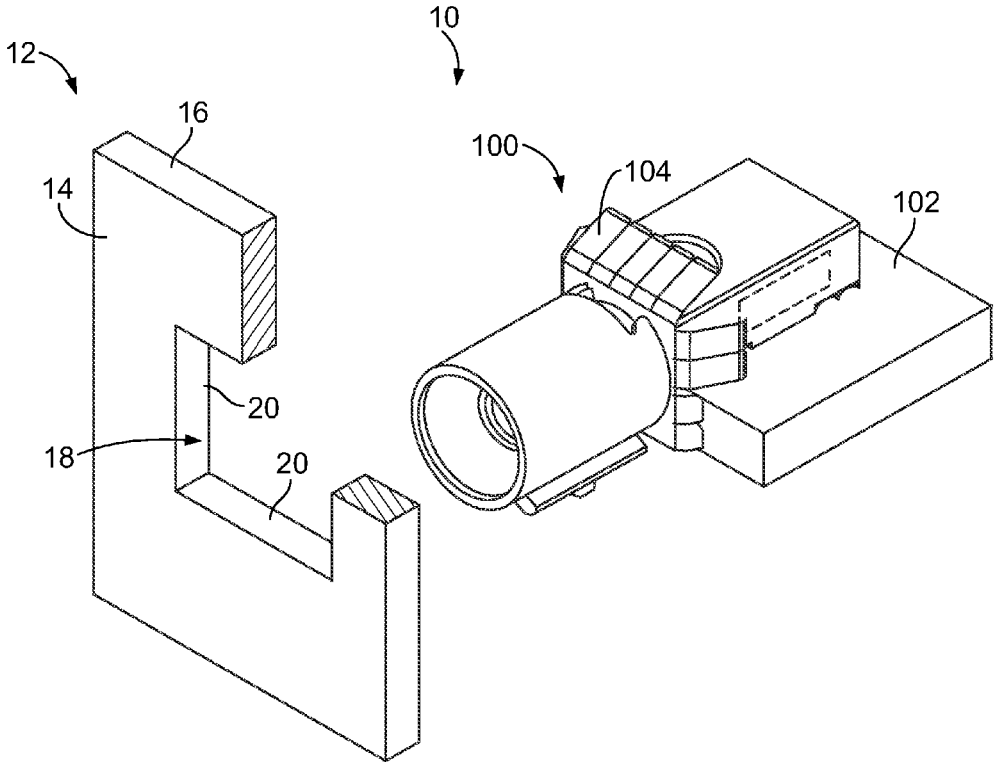
FIG. 1 is a front perspective view of a coaxial connector system utilizing a header assembly formed in accordance with an exemplary embodiment.

FIG. 1 is a front perspective view of a coaxial connector system 10 utilizing a header assembly 100 formed in accordance with an exemplary embodiment. The coaxial connector system 10 includes a device 12, such as a radio, having a casing 14 that houses components of the system 10. The casing 14 is defined by walls or panels 16. One or more of the panels 16 include one or more openings 18 through which the header assembly 100 extends. The opening 18 is defined by corresponding opening walls 20. For example, the panel 16 and opening may be stamped and formed with the opening walls 20 being bent inward to form the opening 18. The opening 18 is sized to load the header assembly 100 therethrough. The header assembly 100 is presented at an exterior of the device 12 for mating with a corresponding connector assembly (not shown).

The header assembly 100 is mounted to a circuit board 102, which may form part of a communication system, such as for an automotive vehicle. For example, the communication system may be used in an automotive application, such as a global positioning system (GPS), car radio, mobile phone, air bag system, multimedia device system, and the like. The system may have use in other types of applications such as aeronautic applications, marine applications, military applications, industrial applications and the like. The circuit board 102 may form part of an antenna. The circuit board 102 may form part of a radio frequency (RF) system.

In the illustrated embodiment, the header assembly 100 constitutes a jack assembly that is configured to be mated with a corresponding plug assembly (not shown). In an exemplary embodiment, the header assembly 100 is a standardized connector, such as a FAKRA standardized connector. The header assembly 100 has features designed according to desired FAKRA specifications. For example, the header assembly 100 may have certain keying configurations.

The header assembly 100 includes a shield member 104 attached thereto. The shield member 104 is used to provide shielding at the opening 18 through which the header assembly 100 is loaded. The opening 18 may be enlarged to receive a portion of the header assembly 100, leaving a large gap between the panel 16 and the header assembly 100. The shield member 104 extends across such gap to provide shielding for the opening 18. The shield member 104 is used to electrically connect the header assembly 100 to the panel 16. For example, the shield member 104 may create a direct electrical path between the panel 16 and the header assembly 100.

Figure 2:
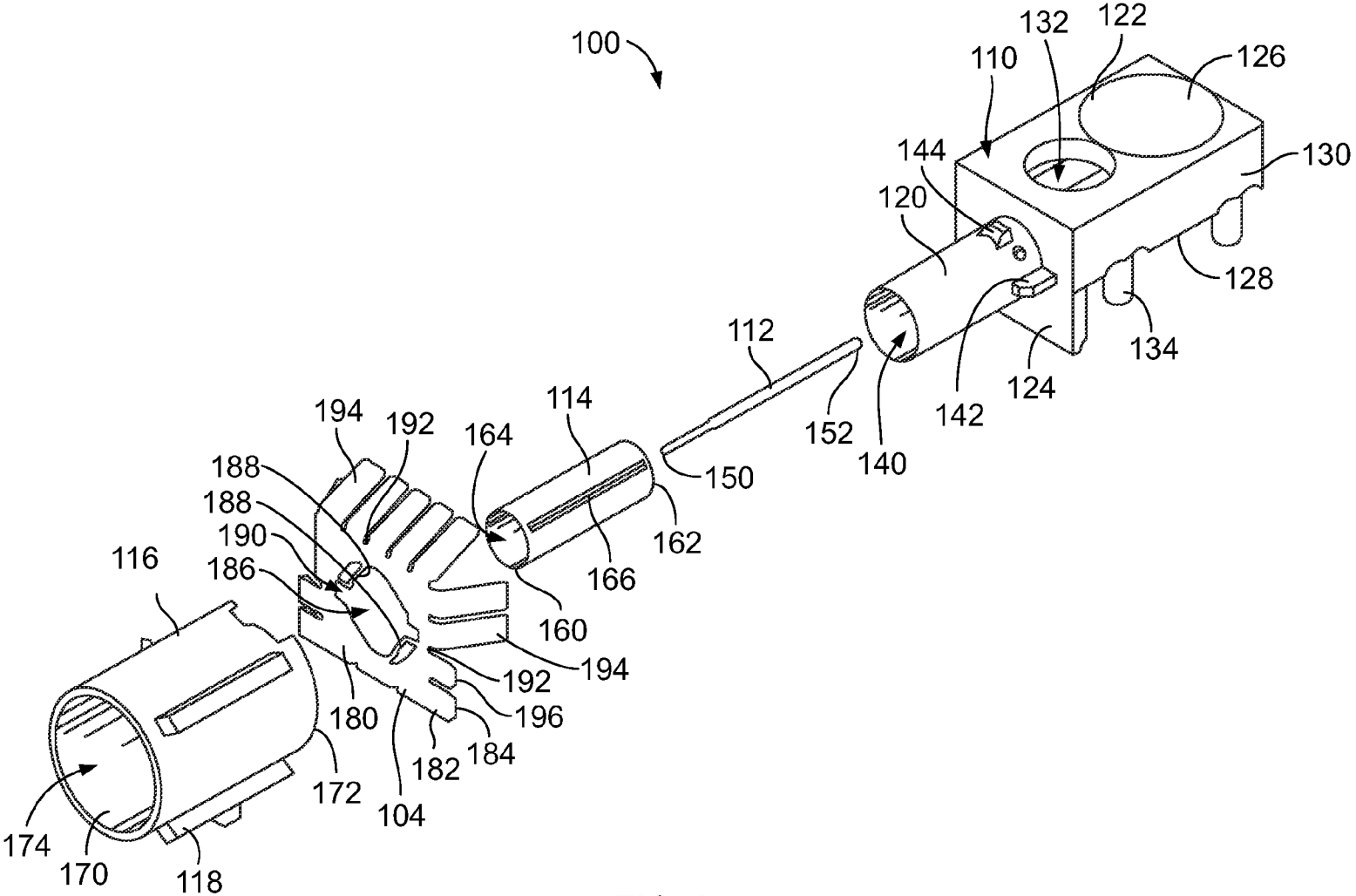
FIG. 2 is an exploded perspective view of the header assembly.

FIG. 2 is an exploded perspective view of the header assembly 100. The header assembly 100 includes an outer housing 110, a center contact 112, a dielectric body 114, the shield member 104 and a nose cone 116. The center contact 112 and dielectric body 114 are received in the outer housing 110. The shield member 104 is coupled to the outer housing 110. The nose cone 116 is coupled to a front of the outer housing 110 to define a mating interface for the mating connector (not shown). The nose cone 116 receives and surrounds the outer contact 120.

In an exemplary embodiment, the nose cone 116 provides an interface keyed according to FAKRA specifications. For example, the nose cone 116 includes keys 118 on an exterior surface thereof. The size, shape and/orientation of the keys 118 may be used to define the different FAKRA interfaces. The mating end of the header assembly 100 defines a FAKRA compliant connector. In an alternative embodiment, the header assembly 100 may be designed to different standards or to mate with a different type of mating connector.

The outer housing 110 has an outer contact 120 and a rear shell 122. The outer housing 110 is manufactured from a conductive material, such as a metal material. In an exemplary embodiment, the outer housing 110 is die cast, however the outer housing 110 may be manufactured by other processes in alternative embodiments, such as stamping and forming. The outer housing 110 is configured to be electrically grounded, such as to the circuit board 102 (shown in FIG. 1), to the mating connector and to the panel 16 (shown in FIG. 1) via the shielding member 104. The outer housing 110 provides electrical shielding for the center contact 112 along an entire length of the center contact 112.

The rear shell 122 is generally boxed shaped, however the rear shell 122 may have other shapes in alternative embodiments. In the illustrated embodiment, the rear shell 122 includes a front wall 124. The rear shell 122 includes a top wall 126 opposite an open bottom 128. The rear shell 122 includes side walls 130 extending rearward from the front wall 124. The walls of the rear shell 122 define a receptacle 132 that receives the center contact 112.

The rear shell 122 provides electrical shielding around the receptacle 132 and the center contact 112. The open bottom 128 of the rear shell 122 may be mounted directly to the circuit board 102. The center contact 112 extends into the rear shell 122 and is exposed along the open bottom 128 for termination to the circuit board 102. For example, the center contact 112 may be surface mounted to the circuit board 102, such as by soldering to the circuit board 102.

The rear shell 122 includes mounting posts 134 extending from the bottom 128. The mounting posts 134 may be loaded into corresponding openings in the circuit board 102 to locate the outer housing 110 relative to the circuit board 102. The mounting posts 134 may be electrically connected to the circuit board 102. For example, the openings in the circuit board 102 may be plated and the mounting posts 134 may be soldered therein. Other types of features may be provided in alternative embodiments to locate and/or secure the outer housing 110 to the circuit board.

The outer contact 120 extends forward from the front wall 124 of the rear shell 122. Optionally, the outer contact 120 may be cylindrical in shape. The outer contact 120 includes a bore 140 that receives the dielectric body 114. The dielectric 114 is held within the bore 140 of the outer contact 120 and surrounds the center contact 112 to provide electrical shielding for the center contact 112.

In an exemplary embodiment, the outer contact 120 includes mounting flanges 142 proximate to the front wall 124 of the rear shell 122. The mounting flanges 142 are used to mount the shield member 104 to the outer housing 110. In an exemplary embodiment, the outer contact 120 includes nose cone latches 144 proximate to the front wall 124 of the rear shell 122. The nose cone latches 144 are used to mount the nose cone 116 to the outer housing 110.

The center contact 112 extends between a mating end 150 and a terminating end 152. In the illustrated embodiment, the mating end 150 constitutes a pin, however other types of mating interfaces may be provided in alternative embodiments. For example, the mating end 150 may be a socket, a blade, deflectable spring beams, or another type of mating interface. The terminating end 152 is configured to be terminated to the circuit board 102. Optionally, the terminated end 152 may be surface mounted to the circuit board 102, such as by using a solder ball, a deflectable spring or another type of interface. In an alternative embodiment, the terminating end 152 may include a straight pin or a compliant pin, such as an eye-of-the-needle pin, for through-hole mounting to a corresponding via of the circuit board 102.

The dielectric body 114 is manufactured from a non-conductive material, such as a plastic material. The dielectric body 114 may be manufactured from an injection molding process. The dielectric body 114 extends between a front 160 and a rear 162. In an exemplary embodiment, the dielectric body 114 is cylindrical in shape. The dielectric body 114 includes a bore 164 extending between the front 160 and the rear 162. The bore 164 receives the center contact therein.

In an exemplary embodiment, the dielectric body 114 includes ribs 166 extending longitudinally along an exterior surface of the dielectric body 114. The ribs 166 may be used to position the dielectric body 114 in the bore 140 of the outer contact 120. The ribs 166 may prevent rotation of the dielectric body 114 within the outer contact 120.

The nose cone 116 is manufactured from a non-conductive material, such as a plastic material. The nose cone 116 may be manufactured by an injection molding processing. The nose cone 116 is generally cylindrical in shape and extends between a front 170 and a rear 172. The nose cone 116 includes a bore 174 extending between the front 170 and the rear 172. The nose cone 116 is configured to be loaded onto the front of the outer housing 110, such that the outer contact 120 is received in the bore 174. The keys 118 extend along an exterior surface of the nose cone 116.

The shield member 104 is configured to be coupled to the outer housing 110 such that the shield member 104 provides shielding for the casing 14 (shown in FIG. 1) and other components of the header assembly 100. The shield member 104 may form an electrically conductive path between the casing 14 and the outer housing 110. The shield member 104 may form an electrically conducted path between the circuit board 102 and the casing 14. The shield member 104 is configured to be coupled to the outer housing 110 generally between the rear shell 122 and the nose cone 116. The shield member 104 is coupled to the outer contact 120 such that the shield member 104 is electrically and mechanically connected to the outer contact 120.

The shield member 104 is manufactured from a conductive material, such as a metal material. The shield member 104 may be manufactured by a stamping and forming process. The shield member 104 includes a plate 180 having a front side 182 and a rear side 184. The plate 180 includes an opening 186 therethrough with spring contacts 188 extending into the opening 186. The spring contacts 188 may be integrally formed with the plate 180. For example, the spring contacts 188 may be stamped out of the plate 180. The spring contacts 188 may be deflectable with respect to the plate 180. Optionally, the spring contacts 188 may be oriented within the plane defined by the plate 180.

When the shield member 104 is coupled to the outer housing 110, the outer contact 120 extends through the opening 186 and the spring contacts 188 engage the outer contact 120 to mechanically and electrically connect the shield member 104 to the outer housing 110. The spring contacts 188 may be spring biased against an exterior surface of the outer contact 120. The spring contacts 188 may hold the shield member 104 on the outer contact 120 by an interference fit between the spring contacts 188 and the outer contact 120.

In an exemplary embodiment, the opening 186 includes notches 190 that receive corresponding mounting flanges 142 of the outer housing 110. The notches 190 may be used to align the shield member 104 with respect to the outer contact 120. When the mounting flanges 142 are received in the notches 190 rotation of the shield member 104 may be restricted. Optionally, the spring contacts 188 may define portions of the notches 190.

The plate 180 includes outer edges 192. A plurality of spring fingers 194 may extend from the plate 180 at the edges 192. The spring fingers 194 may be angled out of the plane defined by the plate 180. The spring fingers 194 may be angled rearwardly. Alternatively, the spring fingers 194 may be angled forwardly. When the shield member 104 is coupled to the outer housing 110, the spring fingers 194 may extend along the rear shell 122. The spring fingers 194 are configured to be spring biased against the casing 14 when the header assembly 100 is coupled to the casing 14. The spring finger 194 form part of a grounding path between the shield member 104 and the casing 14. The spring fingers 194 may be spring biased against the casing 14 to ensure physical contact between the shield member 104 and the casing 14.

In an exemplary embodiment, the shield member 104 includes a plurality of grounding fingers 196 extending from corresponding edges 192 of the plate 180. The grounding fingers 196 are configure to engaged, and be electrically connected to, a ground circuit of the circuit board 102. For example, the grounding fingers 196 may directly engage the circuit board to connect to a ground layer of the circuit board 102. The grounding fingers 196 may be spring biased against pads or portions of a ground plane of the circuit board 102.

Figure 3:
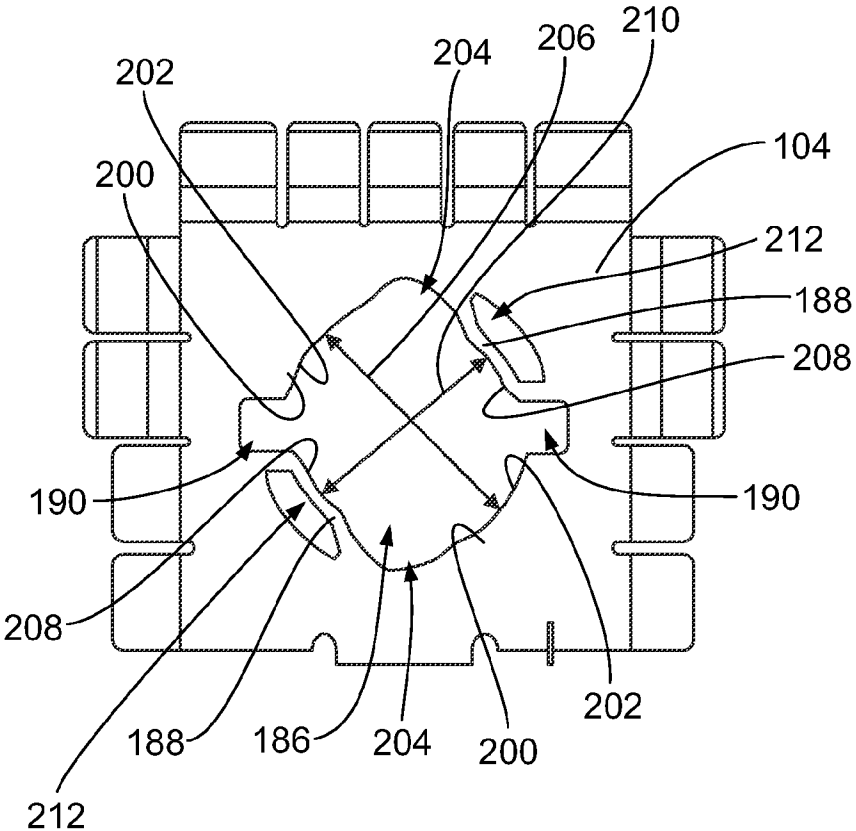
FIG. 3 is a front view of a shield member for the header assembly.

FIG. 3 is a front view of the shield member 104. The opening 186 has fixed sections 200 having curved interior surfaces 202 defining portions of the openings 186. The notches 190 are positioned along the sides of the fixed sections 200. Cutouts 204 are provided to provide clearance for the nose cone latches 144 (shown in FIG. 2) during loading of the shield member 104 onto the outer contact 120 (shown in FIG. 2). The cutouts 204 are positioned between fixed sections 200 and spring contacts 188. The notches 190 are positioned between fixed sections 200 and spring contacts 188.

The interior surfaces 202 of the fixed sections 200 are separated by a distance 206 corresponding to a diameter of the outer contact 120. The distance 206 may be slightly larger than the diameter of the outer contact 120 to allow the outer contact 120 to pass through the opening 186. The spring contacts 188 have interior surfaces 208 defining portions of the openings 186. The interior surfaces 208 are separated by a distance 210 that is less than the distance 206. The distance 210 may be less than the diameter of outer contact 120. When the shield member 104 is coupled to the outer contact 120 the spring contacts 188 may be at least partially deflected radially outward by the outer contact 120. Such deflection causes the spring contacts 188 to be spring biased against the outer contact 120 to mechanically and electrically connect the shield member 104 to the outer contact 120. In an exemplary embodiment, deflection windows 212 are provided radially outward of the spring contacts 188. The deflection windows 212 provide a space for the spring contacts 188 to deflect when the shield member 104 is coupled to the outer contact 120.

Figure 4:
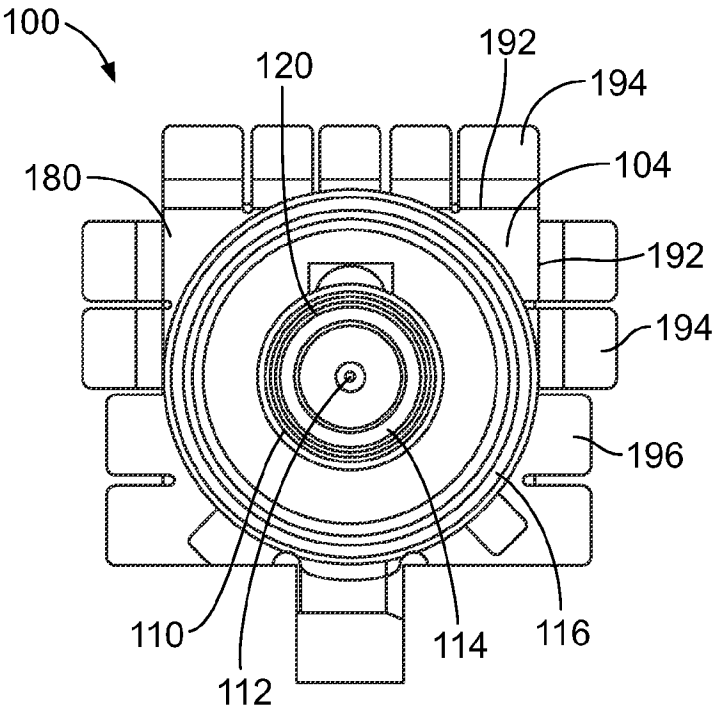
FIG. 4 is a front view of the header assembly.

FIG. 4 is a front view of the header assembly 100. When assembled, the center contact 112 is loaded into the dielectric body 114, and the dielectric body 114 and center contact 112 are loaded into the outer contact 120 of the outer housing 110. The shield member 104 is coupled to the outer housing 110. The nose cone 116 is coupled to the outer housing 110 forward of the shield member 104. The shield member 104, outer housing 110, center contact 112, dielectric body 114 and nose cone 116 are configured to be mounted to or coupled to the casing 14 (shown in FIG. 1) as a unit.

The opening 18 (shown in FIG. 1) in the panel 16 (shown in FIG. 1) is sized large enough to receive the nose cone 116 there through. To close off the opening 18, the shield member 104 is oversized, being generally larger than the nose cone 116. For example, the edges 192 of the plate 180 are spaced apart by distance approximately equal to or greater than the diameter of the nose cone 116. The shield member 104 is configured to be at least partially received in the opening 18 such that the spring fingers 194 engage the panel 16 to close off the openings 18. Alternatively, rather then being received in the opening 18, the shield member 104 may engage an interior side of the panel 16, effectively closing off the opening 18.

Figure 5:
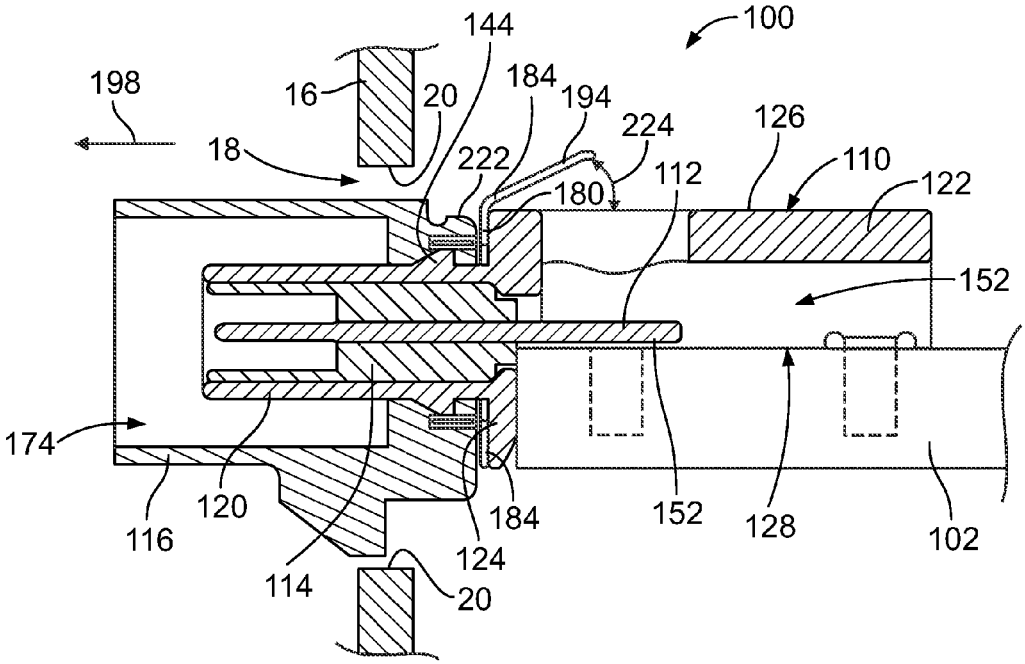
FIG. 5 is a side cross sectional view of the header assembly.
Figure 6:
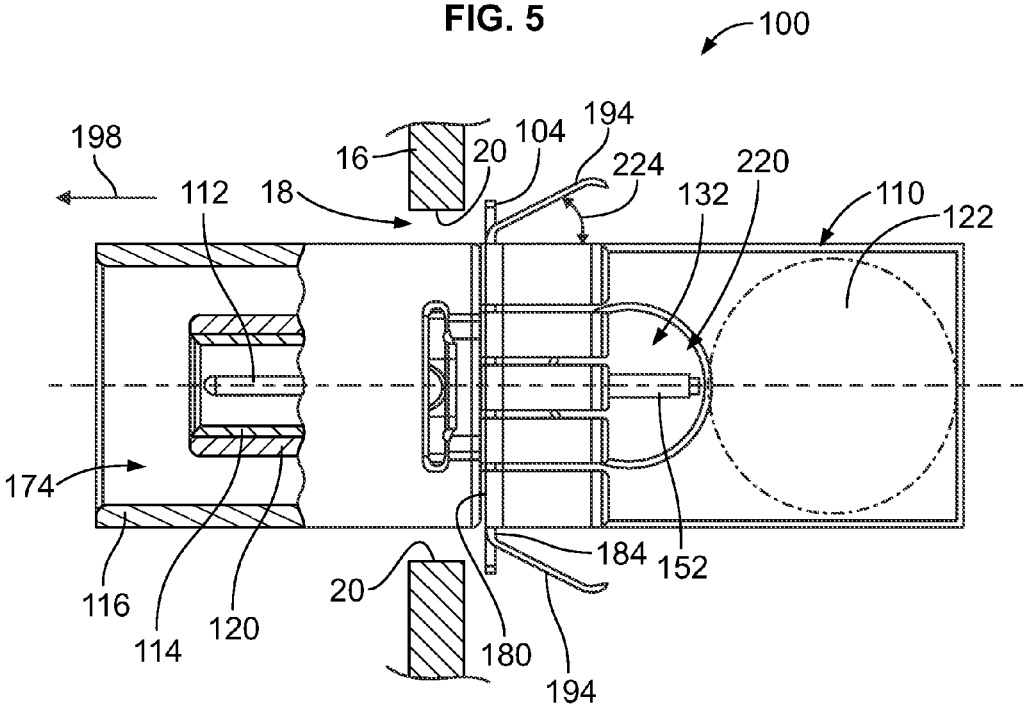
FIG. 6 is a top cross sectional view of the header assembly.

FIG. 5 is a side cross sectional view of the header assembly 100. FIG. 6 is a top cross sectional view of the header assembly 100. Both FIGS. 5 and 6 illustrate a portion of the casing 14, showing the header assembly 100 being loaded into the opening 18 in a loading direction 198. The header assembly is configured to be loaded until the shield member 104 is aligned within the opening 18, with the shield member 104 effectively electrically closing the opening 18 to reduce or eliminate EMI leakage through the opening 18.

The center contact 112 is shown received in and supported by the dielectric body 114. The dielectric body 114 is shown received in and supported by the outer contact 120. The center contact 112 extends rearward of the front wall 124 into the receptacle 132 of the rear shell 122. The terminating end 152 of the center contact 112 is coplanar with the bottom 128 of the rear shell 122. When the header assembly 100 is mounted to the circuit board 102, the bottom 128 rests on the circuit board 102 with the terminating end 152 of the center contact 112 also resting on the circuit board 102 for surface mounting to the circuit board 102. An opening 220 in the top wall 126 of the rear shell 122 provides access to the terminating end 152, such as for soldering the terminating end 152 to the circuit board 102.

The nose cone 116 is coupled to the outer housing 110. For example, the nose cone latches 144 capture flanges 222 of the nose cone 116 to secure the nose cone 116 to the outer housing 110. The outer contact 120 extends into the bore 174 of the nose cone 116 and is configured to be mated to the mating connector assembly.

When the header assembly 100 is fully seated within opening 18, the shield member 104 is captured between the nose cone 116 and the front wall 124 of the rear shell 122. The rear side 184 of the plate 180 abuts against the front wall 124. In an exemplary embodiment, the shield member 104 directly engages the rear shell 122 to provide an electrical interface between the shield member 104 and the rear shell 122.

The spring fingers 194 extend rearward along the rear shell 122. Prior to loading the header assembly 100 into the casing 14, the spring fingers 194 are angled at an angle 224 with respect to the rear shell 122. Once the header assembly 100 is loaded into the opening 18, the spring fingers 194 engage the opening walls 20. The opening walls 20 deflect the spring fingers 194 toward the rear shell 122. The spring fingers 194 are thus spring biased against the casing 14. For example, the spring fingers 194 may be deflected such that the spring fingers 194 extend longitudinally along an exterior of the outer housing 110. Optionally, the spring fingers 194 may be deflected such that the spring fingers 194 extend generally parallel to the rear shell 122 of the outer housing 110. In alternative embodiments, rather than being received in the opening 18, the spring fingers 194 may be configured to engage an interior side of the casing 14 while covering the opening 18 to provide shielding through the opening 18.

Once the spring fingers 194 are deflected, the spring fingers 194 are biased against the opening walls 20 of the panel 16. Spring forces of the spring fingers 194 maintain direct physical contact between the spring fingers 194 and the panels 16 to maintain an electrical connection between the header assembly 100 and casing 14. The shield member 104 closes off the opening 18 to reduce and/or eliminate EMI leakage through the opening 18. The shield member 104 is easily positioned to close off the opening 18 because the shield member 104 is part of the header assembly 100 and is loaded into the opening 18 with the nose cone 116 and outer housing 110 as a unit. There is no need for mounting additional plates to cover the opening after the header assembly 100 is in place, as is typical of conventional systems. When the device 12 has need for multiple header assemblies 100, each corresponding opening 18 in the casing 14 is closed by the corresponding header assembly 100 itself, namely by the shield member 104. Assembly time is reduced and fewer parts are needed to assembly the device 12.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means plus-function format and are not intended to be interpreted based on 35 U.S.C. §112, sixth paragraph, unless and until such claim limitations expressly use the phrase "means for" followed by a statement of function void of further structure.

What is claimed is:

1. A header assembly configured to be coupled to a casing, the header assembly comprising:

a center contact extending along a longitudinal axis;

a dielectric body surrounding the center contact;

an outer housing holding the center contact and the dielectric body, the outer housing having a rear shell configured to be mounted to a circuit board and configured to be positioned interior of the casing, the outer housing having an outer contact extending from the rear shell, the outer contact being configured to extend through an opening in the casing with a portion of the outer contact positioned exterior of the casing, the dielectric body being received in the outer contact; and a shield member coupled to the outer housing, the shield member engaging the outer contact to electrically connect the shield member to the outer housing, the shield member having spring fingers being configured to engage the casing at the opening, wherein at least a portion of each spring finger passes into the opening in the casing, the spring fingers being biased against corresponding opening walls defining the opening, the spring fingers being configured to electrically connect the outer housing to the casing.

2. The header assembly of claim 1, wherein the shield member is coupled to the outer housing prior to coupling the header assembly to the casing, the shield member being loaded into electrical connection with the casing with the outer housing as a unit.

3. The header assembly of claim 1, wherein the shield member directly engages both the outer contact and the rear shell.

4. The header assembly of claim 1, wherein the shield member includes grounding fingers, the grounding fingers being configured to engage and be electrically connected to a ground circuit of the circuit board.

5. The header assembly of claim 1, wherein the spring fingers are deflectable toward the rear shell when engaging the casing.

6. The header assembly of claim 1, wherein the rear shell includes a front wall, the outer contact extending forward from the front wall, the shield member abutting against the front wall with the spring fingers extending rearward along the rear shell.

7. The header assembly of claim 1, wherein the shield member includes spring contacts engaging the outer contact and electrically connecting the shield member to the outer contact, the spring contacts being spring biased against the outer contact to hold the shield member on the outer housing by an interference fit.

8. The header assembly of claim 1, wherein the shield member includes a plate, the spring fingers extending from corresponding edges of the plate, the plate having an opening therethrough, spring contacts extending into the opening of the plate, the spring contacts mechanically and electrically connecting the shield member to the outer contact, the outer contact being received in the opening of the plate and engaging the spring contacts in the opening of the plate.

9. The header assembly of claim 1, further comprising a nose cone coupled to a front end of the outer housing, the nose cone surrounding the outer contact, the nose cone having keys along an exterior thereof, wherein the shield member is captured between the nose cone and the rear shell.

10. A header assembly configured to be coupled to a casing, the header assembly comprising:

a center contact extending along a longitudinal axis;

a dielectric body surrounding the center contact;

an outer housing holding the center contact and the dielectric body, the outer housing having a rear shell configured to be mounted to an edge of a circuit board and configured to be positioned interior of the casing, the outer housing having an outer contact extending forward of the rear shell and the edge of the circuit board, the outer contact being configured to extend through an opening in the casing with a portion of the outer contact positioned exterior of the casing, the dielectric body being received in the outer contact; and a shield member coupled to the outer housing, the shield member including a plate having edges and an opening therethrough, the shield member having spring contacts, the spring contacts extending into the opening of the plate, the outer contact being received in the opening of the plate and engaging the spring contacts in the opening of the plate to electrically connect the shield member to the outer housing, the shield member having spring fingers extending from corresponding edges of the plate, the spring fingers extending rearward from the plate along the rear shell, the spring fingers being configured to engage a corresponding opening wall surrounding the opening in the casing, the spring fingers being configured to electrically connect the outer housing to the casing.

11. The header assembly of claim 10, wherein the shield member is coupled to the outer housing prior to coupling the header assembly to the casing, the shield member being loaded into electrical connection with the casing with the outer housing as a unit.

12. The header assembly of claim 10, wherein the shield member directly engages both the outer contact and the rear shell.

13. The header assembly of claim 10, wherein at least a portion of each spring finger passes into the opening in the casing.

14. The header assembly of claim 10, wherein the spring fingers are deflectable toward the rear shell when engaged by the opening wall.

15. The header assembly of claim 10, wherein the rear shell includes a front wall, the outer contact extending forward from the front wall, the shield member abutting against the front wall with the spring fingers extending rearward along the rear shell.

16. The header assembly of claim 10, wherein the spring contacts are spring biased against the outer contact to hold the shield member on the outer housing by an interference fit.

17. The header assembly of claim 10, further comprising a nose cone coupled to a front end of the outer housing, the nose cone surrounding the outer contact, the nose cone having keys along an exterior thereof, wherein the shield member is captured between the nose cone and the rear shell.

18. A header assembly configured to be coupled to a casing, the header assembly comprising:

a center contact extending along a longitudinal axis;

a dielectric body surrounding the center contact;

an outer housing holding the center contact and the dielectric body, the outer housing having a rear shell configured to be mounted to an edge of a circuit board and configured to be positioned interior of the casing, the outer housing having an outer contact extending forward of the rear shell and the edge of the circuit board, the outer contact being configured to extend through an opening in the casing with a portion of the outer contact positioned exterior of the casing, the dielectric body being received in the outer contact;

a nose cone coupled to a front end of the outer housing, the nose cone surrounding the outer contact, the nose cone having keys along an exterior thereof defining a Fachnormenausschuss Kraftfahrzeugindustrie (FAKRA) mating interface; and a shield member coupled to the outer housing between the nose cone and the rear shell, the shield member having spring contacts engaging the outer contact to electrically connect the shield member to the outer housing, the shield member having spring fingers extending longitudinally along an exterior of the outer housing, the spring fingers being configured to engage a corresponding opening wall surrounding the opening in the casing, the spring fingers being configured to electrically connect the outer housing to the casing.

19. The header assembly of claim 18, wherein the shield member includes a plate, the spring fingers extending from corresponding edges of the plate, the plate having an opening therethrough, the spring contacts extending into the opening of the plate, the outer contact being received in the opening of the plate and engaging the spring contacts in the plate.

* * * * *